United States Patent [19]

Day et al.

[11] 4,171,663

[45] Oct. 23, 1979

[54] TENSION FRACTURE FITTING IN MISSILE SEPARATION THRUSTER

[75] Inventors: John H. Day, Pacific Palisades; Jerre T. Hawk, Los Angeles, both of Calif.

[73] Assignee: The United States of America as represented by the Secretary of the Army, Washington, D.C.

[21] Appl. No.: 853,920

[22] Filed: Nov. 22, 1977

[51] Int. Cl.[2] ..... F15B 15/00

[52] U.S. Cl. ..... 89/1 B; 102/49.4

[58] Field of Search ..... 102/49.4, 49.5; 89/1 B; 85/DIG. 1, 1 R

[56] References Cited

U.S. PATENT DOCUMENTS

| | | | |
|---|---|---|---|
| 3,119,302 | 1/1964 | Barr | 89/1 B |
| 3,160,098 | 12/1964 | Schulze et al. | 102/49.5 |
| 3,597,919 | 8/1971 | Lilly | 102/49.5 |
| 3,888,158 | 6/1975 | Temple | 89/1 B |

*Primary Examiner*—Verlin R. Pendegrass

*Attorney, Agent, or Firm*—William G. Gapcynski; Werten F. W. Bellamy; James T. Deaton

[57] ABSTRACT

A tension fracture fitting is mounted between two stages of a missile and is fractured by separation thruster mechanism at an appropriate time to separate the missile stages and to guide the missile stages and prevent lateral translation between the two stages during initial separation.

2 Claims, 2 Drawing Figures

TENSION FRACTURE FITTING IN MISSILE SEPARATION THRUSTER

DEDICATORY CLAUSE

The invention described herein may be manufactured, used, and licensed by or for the Government for governmental purposes without the payment to us of any royalties thereon.

BACKGROUND OF THE INVENTION

In the past, various separation devices have been fabricated for separation of one missile stage from another. However, these devices have not always been successful and practical in all missile systems or in a larger missile as required by applicants' invention. Various prior art separation devices are of the types taught in Lauritsen et al, U.S. Pat. No. 2,458,475, Lightbody et al, U.S. Pat. No. 2,745,347, Everett, U.S. Pat. No. 2,814,250, Adelman et al, U.S. Pat. No. 2,945,442, Mitchum, Jr., U.S. Pat. No. 3,116,895, Crockett, U.S. Pat. No. 3,377,952, Mayo, U.S. Pat. No. 3,427,047 and Carr, U.S. Pat. No. 3,505,925. Each of these patents disclose various arrangements for separating structures that are releasable one from the other. However, none of the prior art structures are suitable for applicants' purpose in which it is desired to have a tension attachment between two stages of a missile that can be easily adjusted and separated by a power attachment at a predetermined break away pressure due to the tension fitting having a necked down or weakened portion.

Therefore, it is an object of this invention to provide a one piece tension fitting that is easily mountable between rocket stages, adapted to be broken and adapted to guide the stages as they separate and allow the stages to separate when a predetermined amount of pressure has been applied to the tension fitting.

Another object of this invention is to provide a tension fitting that can be accurately mounted between the stages with simple adjusting means in installing the tension fitting.

Still another object of this invention is to provide a tension fitting in which lateral translation between the two stages is prevented during the initial movement of the stages away from each other.

A still further object of this invnetion is to provide a tension fitting which lends itself to the optimum combination of strength, lightweight and size.

SUMMARY OF THE INVENTION

In accordance with this invention, a tension fitting is provided that is utilized for interconnecting two stages of a missile. The tension fitting is adapted for easy and accurate installation relative to adjustment and also is utilized in guiding the two stages as they are being separated. The tension fitting has an intermediate fracture zone that is fractured by a separation thruster arrangement that breaks the tension fitting at the fracture zone to cause the two stages to be separated.

DESCRIPTION OF THE PREFERRED EMBODIMENT

Figure 1:
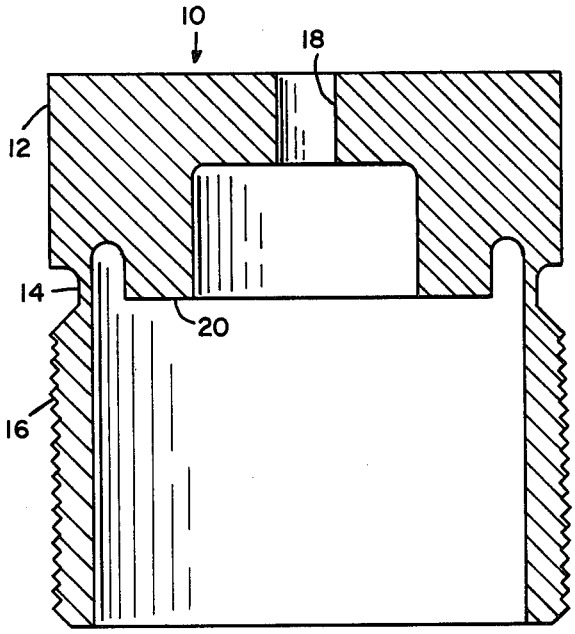
FIG. 1 is a sectional view of a tension fitting in accordance with this invention.

Referring now to the drawing, FIG. 1 shows a tension fitting 10 that is generally cylindrical with a first guide section 12 a necked down portion 14 and a threaded section 16. Guide section 12 has a stepped bore therethrough with small diameter bore 18 thereof for use in attaching the tension fitting to the separate stages. A base 20 of guide section 12 provides a flat surface to which force can be applied to cause necked down portion 14 to be broken at the appropriate time.

Figure 2:
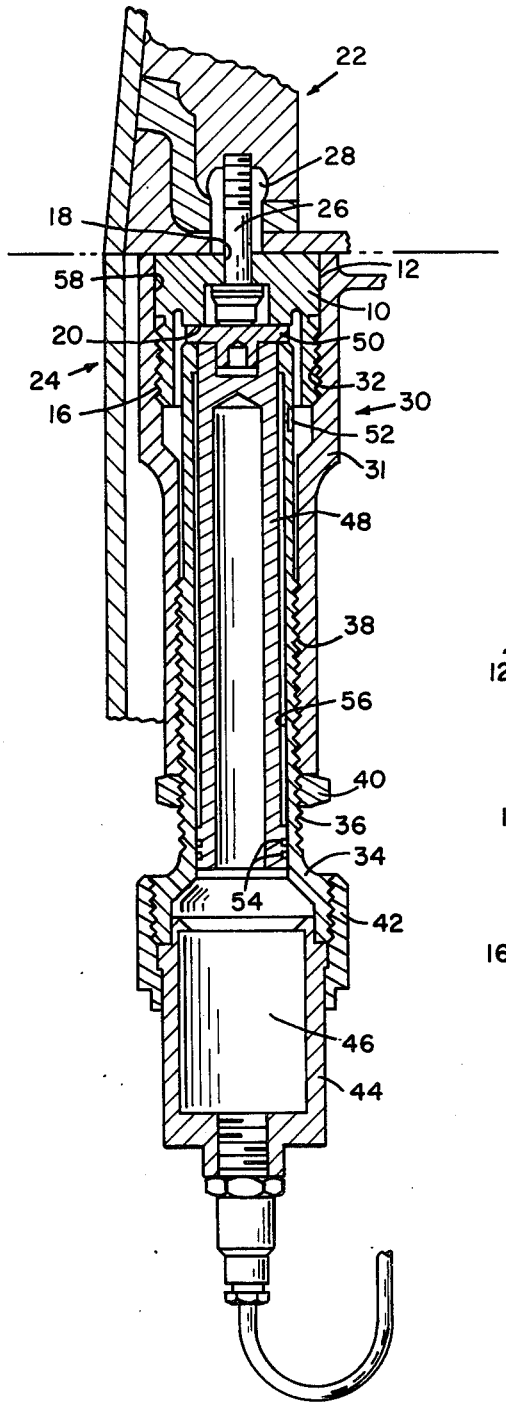
FIG. 2 is a sectional view partially cut away illustrating the tension fitting mounted between two stages of a missile illustrated partially diagrammatically.

Referring now to FIG. 2, tension fitting 10 of aluminum is shown mounted between upper stage 22 and lower stage 24. A bolt 26 is inserted through bore or hole 18 and threaded into nut 28 mounted in upper stage 22. With this arrangement, bolt 26 allows for accurate mounting and adjustment of tension fitting 10 relative to upper stage 22. A separation thruster 30 includes a generally cylindrical thrust member 31 that has threads 32 threaded onto threads 16 of tension fitting 10. A power cylinder 34 is externally threaded at 36 and is threaded into threaded section 38 of thrust fitting 31. A jam nut 40 is used to secure members 31 and 34 in fixed relation once they have been fastened together. Power cylinder 34 has a coupling nut 42 threaded thereto and couples power cartridge 44 to the power cylinder. Power cartridge 44 has a conventional gas type generator means 46 therein with conventional means for setting off the gas generator when desired to produce gas. Power cylinder 34 has a piston 48 slidably mounted therein and has one end 50 that rests on surface 20 of tension fitting 10. Power cylinder 34 has a vent hole 52 therein for venting the space between piston 48 and power cylinder 34 when pressure from gas generator 46 moves piston 48 that is sealed by seals 54 to intercylindrical surface 56. When securing two missile stages together as shown herein, generally a plurality, such as about four tension fittings, are used with four power cylinder arrangements for separating the two stages.

In operation, during booster flight, tension fitting 10 and bolt 26 constitute the tension means that attaches stage 22 to stage 24. At separation, separation thruster 30 is activated when gas generator 46 is fired in a conventional manner and the gas generated by gas generator 46 applies force to piston 48 that applies force to base 20 of tension fitting 10 and causes the tension fitting to fracture in the necked down portion 14 when the applied load from separation thruster 30 reaches approximately 6,700 pounds. This applied load is transmitted by the gases from gas generator 46 to apply pressure to piston 48 and end 50 of piston 48 against surface 20 of tension fitting 10. Gas generator 46 is ignited in any conventional manner. For the initial 0.60 inch of travel, cylindrical surface 12 of tension fitting 10 is surrounded by cylindrical surface 58 of thrust fitting 31 to thereby prevent lateral translation of the two stages at separation and guidance of the two stages relative to each other.

We claim:

1. A device for interconnecting two objects to be separated, comprising a tension fitting of general cylindrical configuration and having a stepped bore therethrough defining an inner flat surface, said tension fitting having a necked down portion between opposite ends of the tension fitting with an outer surface on one side of the necked down portion being threaded, an outer portion on the other side of the necked down portion being a cylindrical guide surface, the surface at the end of the cylindrical guide surface being flat, said tension fitting being fastened to one of said devices by a bolt extending into said stepped bore and being threaded into a nut in one of said objects, and a separation thruster threadably mounted to said outer threaded portion of said tension fitting and having a portion which telescopes over said outer portion on said other side of said necked down portion and forming a guide for said cylindrical guide surface, said separation thruster being disposed for applying a force to the inner flat surface of said tension fitting to cause the fitting to be fractured at said necked down portion and cause said cylindrical guide surface to be moved and guided out of said portion which telescopes over said outer portion.

2. A device as set forth in claim 1, wherein said separation thruster includes a cylindrical thrust member that is threaded to said outer threaded portion, said thrust member having an inner threaded portion to which a power cylinder is threaded into the cylindrical thrust member, and a piston slidably mounted in said power cylinder and having one end which contacts the inner flat surface to apply force thereto.

* * * * *